US007100283B1

(12) United States Patent
Grdodian et al.

(10) Patent No.: US 7,100,283 B1
(45) Date of Patent: Sep. 5, 2006

(54) SHAVING SYSTEM

(76) Inventors: Greg Grdodian, 21 Patton Ct., Wayne, NJ (US) 07470; Victor Hayek, 15 S. Hall Ct., Wayne, NJ (US) 07470

( * ) Notice: Subject to any disclaimer, the term of this patent is extended or adjusted under 35 U.S.C. 154(b) by 124 days.

(21) Appl. No.: 10/967,822

(22) Filed: Oct. 18, 2004

(51) Int. Cl.
*B26B 21/00* (2006.01)

(52) U.S. Cl. ..... 30/41.7; 30/34.05

(58) Field of Classification Search ..... 30/41.7; 7/167; 81/489
See application file for complete search history.

(56) References Cited

U.S. PATENT DOCUMENTS

| | | | | |
|---|---|---|---|---|
| 2,328,336 | A | 8/1943 | Gilford | 30/41.7 |
| 2,750,664 | A | 6/1956 | Merlo | 30/41.7 |
| 3,137,939 | A | 6/1964 | Waldeck | 30/41.7 |
| 3,233,322 | A | 2/1966 | Sparagi et al. | 30/41.7 |
| 4,208,984 | A | 6/1980 | Glanzman | 30/41.7 |
| 5,062,209 | A | 11/1991 | Rais | 30/41.7 |
| 5,347,715 | A | 9/1994 | Friedland | 30/41.7 |
| 5,956,850 | A * | 9/1999 | Poulsen | 30/41.7 |
| 6,009,623 | A | 1/2000 | Orloff | 30/41.7 |
| 6,460,251 | B1 | 10/2002 | Orloff | 30/41.7 |
| 6,708,408 | B1 | 3/2004 | Orloff | 30/41.7 |
| 2002/0189102 | A1 * | 12/2002 | Orloff | 30/41.7 |

FOREIGN PATENT DOCUMENTS

| | | |
|---|---|---|
| FR | 2.758.757 | 1/1997 |
| WO | WO95/22444 | 8/1995 |

* cited by examiner

*Primary Examiner*—Derris H. Banks
*Assistant Examiner*—Sean M. Michalski
(74) *Attorney, Agent, or Firm*—Michael I. Kroll

(57) ABSTRACT

A shaving system includes a razor body having a blade releaseably secured at a first distal end thereof. A processor having a timing mechanism is positioned within the razor body. A pressure sensor is positioned externally on the razor body for selectively determining if the razor body is being gripped. A movement sensor is positioned adjacent to the blade and within the razor body for selectively determining whether the blade is moving along a surface. Both the pressure sensor and movement sensor are coupled to the processor. The system further includes means for indicating that the blade should be replaced. Upon the pressure sensor and the movement sensor being activated simultaneously, the timing mechanism is caused to count down from a predetermined initial value representing an amount of time required until the blade needs to be replaced which is indicated by the indicating means.

15 Claims, 10 Drawing Sheets

SHAVING SYSTEM

BACKGROUND OF THE INVENTION

1. Field of the Invention

The present invention relates generally to a shaving system and, more specifically, to a razor that notifies a user to replace a blade connected thereto. The system of the present invention includes sensors so that when gripped by a user and the razor blade head is activated, a processor counts down from a pre-determined time which represents the amount of shaving time before the blade is dulled. The time remaining until the blade needs to be replaced is displayed by LED lights whereby upon all lights being extinguished, the blade should be replaced with a new blade. Upon depressing a blade release switch positioned on the razor body, the timer of the CPU is reset.

2. Description of the Prior Art

Numerous other types of shaving systems exist in the prior art. Typical of these are U.S. Pat. Nos. 2,328,336; 2,750,664; 3,137,939; 3,233,322; 4,208,984; 5,062,209; 5,347,715; 6,009,623; 6,460,251; 6,708,408 and WO95/22444 and French Patent No. 2,758,757. While these devices may be suitable for the purposes for which they were designed, they would not be as suitable for the purposes of the present invention, as hereinafter described.

U.S. Pat. No. 2,328,336

Inventor: Charles Frederick Gilford

Issued: Aug. 31, 1943

The process of shaving, if a wide swath of beard, representd by the full length of the edge of the razor blade is to be cut satisfactorily, the blade must be in the best condition.

U.S. Pat. No. 4,208,984

Inventor: Norman Glanzman

Issued: Jun. 24, 1980

Apparatus for monitoring razor usage. The apparatus comprises an indicator means supported within a hollow handle portion of the razor and slidable to selected positions along the length thereof for alignment with numbered indicia on the handle to permit monitoring the number of times that the razor has been used. The apparatus provided may be used with razors of either the reusable or disposable type and can be incorporated into such razors with only minor alteration of the razor design.

U.S. Pat. No. 6,460,251

Inventor: Glennis J. Orloff

Issued: Oct. 8, 2002

The present invention is directed to a wet shaving system having an electronic indicator for indicating when the blades are becoming dull and in need of replacement. As razor blades dull, the user must exert greater force during shaving to achieve a satisfactory shave. Upon exertion of this extra force, a piston which is adjacent to the blades moves away from the blades in response to the increased forces encountered by the blades during shaving. Upon moving a sufficient distance, the piston pushes into an electronic device, such as a potentiometer, which initiates a signal processing circuit which in turn activates an indicator, such as a light-emitting diode. The activation of the indicator is a signal to the user to replace the blades.

U.S. Pat. No. 2,750,664

Inventor: Mario P. Merlo

Issued: Jun. 19, 1956

The present invention relates broadly to indicators and more specifically to an indicator which may be incorporated in a razor of the safety type, for indication to the user of the razor the number of times that a blade has been used. The present invention has no relationship to tensioning indicating devices for razor blades used in the so-called safety razors.

U.S. Pat. No. 5,062,209

Inventor: Elliot Rais

Issued: Nov. 5, 1991

A disposable razor comprising a blade holder, a blade in the blade holder, a handle connected to the blade holder and a blade cover. In order to indicate the number of times the blade has been used, tabs are integrally formed on the handle, blade holder or the blade cover and bendable about a pivot line from a first position indicating non-use to a second position indicating one use and indicia associated with each tab.

U.S. Pat. No. 6,708,408

Inventor: Glennis J. Orloff

Issued: Mar. 23, 2004

The present invention is directed to a shaving system having an indicator for indicating when the blades are becoming dull and in need of replacement. As razor blades dull, the user must exert greater force during shaving to achieve a satisfactory shave. Upon exertion of this extra force, a piston which is adjacent to the blades moves away from the blades in response to the increased forces encountered by the blades during shaving. Upon moving a sufficient distance, the piston activates a sensor, such as a potentiometer, which initiates a signal processing circuit which in turn activates an indicator, such as a light-emitting diode. The activation of the indicator is a signal to the user to replace the blades.

U.S. Pat. No. 3,137,939

Inventor: George A. Waldeck

Issued: Jun. 23, 1964

The present invention generally relates to safety razors, and more particularly to a means for insuring a proper use of both sides of a razor blade so as to obtain the maximum efficiency therefrom.

U.S. Pat. No. 5,347,715

Inventor: Donald H. Friedland

Issued: Sep. 20, 1994

A blade shave counter is disclosed which counts the number of shaves for which an interchangeable shaving blade has been used, and displays the count on an LCD display mounted preferably on the shaving handle of a shaving instrument. Optionally, an audible alarm sounds or an LED is activated when the count reaches a predetermined or user selectable value.

U.S. Pat. No. WO9522444

Inventor: Brian Charles Ward

Issued: Aug. 24, 1995

A disposable safety razor (10) having usage indicators (16) formed integrally in the handle (11). The usage indicators are in the form of pressure sensitive marker elements in linear array on the handle which respond to digital pressure, the preferred embodiment comprising a series of spaced, upstanding, deformable plastic bubbles.

U.S. Pat. No. 3,233,322

Inventor: Edward Sparagi et al.

Issued: Feb. 8, 1966

This invention relates primarily to safety razors and to mean mounted theron for counting the number of shaves effected by means of a singal razor blade.

U.S. Pat. No. 6,009,623

Inventor: Glennis J. Orloff

Issued: Jan. 4, 2000

The present invention discloses a wet shave shaving system which contains an in situ sensor within the razor cartridge or razor handle. The sensor preferably comprises either a piezoelectric or a piezoresistive material which produces an electrical signal or resistance change when it is strained. In an active feedback system, the signal would be transferred from the cartridge to the razor handle where an electronically-active actuator would extend or retract as necessary to position the cartridge to produce a shave with a constant shave force. In a passive feedback system, the signal would be transferred from the cartridge to the handle where an electronically-activated element, such as an indicator light, would be activated to produce an indication to the user that he or she should reposition the razor to produce a constant shave force. In an alternative embodiment, the passive feedback system signal would provide an indication to the user that the blades are worn and the cartridge or razor should be replaced.

European Patent Number FR 2 758 757

Inventor: Bruno Sanges

Issued Jul. 31, 1998

The wet razor comprises a handle (1) supporting a shaving blade holder (2). It is integral with a mechanical counter intended to be incremented after each shave, and controlling a roller indicator (5) for indicating blade wear. The counter comprises a push button (7) which is activated after each shave to give limited rotation of the indicator roller for each increment.

SUMMARY OF THE PRESENT INVENTION

The present invention relates generally to a shaving system and, more specifically, to a razor that notifies a user to replace a blade connected thereto. The system of the present invention includes sensors so that when gripped by a user and blade head is activated, a processor counts down, after a short delay, from a pre-determined time which represents the amount of shaving time before the blade is dulled. The time remaining until the blade needs to be replaced is displayed by a decreasing number of LED lights whereby upon all lights being extinguished, the blade should be replaced with a new blade. Upon depressing a blade release switch positioned on the razor body, the timer of the CPU is reset.

A primary object of the present invention is to provide a shaving system that overcomes the shortcomings of the prior art.

Another object of the present invention is to provide a shaving system including a razor body having a pivotal blade head removeably connected at a first distal end thereof.

A further object of the present invention is to provide a shaving system having a processor for counting down time from a stored pre-determined amount of time.

An even further object of the present invention is to provide a shaving system wherein the pre-determined amount of time represents the amount of time required to dull a razor blade.

Yet another object of the present invention is to provide a shaving system including multiple pressure sensors positioned around a shaft.

A still further object of the present invention is to provide a shaving system having a razor head movement sensor spaced apart from the pivotal blade head.

Another object of the present invention is to provide a shaving system wherein the at least one shaft pressure sensor and the razor head movement sensor are coupled to the processor.

Yet another object of the present invention is to provide a shaving system wherein upon activation of both the shaft pressure sensor and the razor head movement sensor, the processor counts down from the stored pre-determined time value.

A further object of the present invention is to provide a shaving system including an indicator positioned on a handle of the razor for indicating the time remaining before the blade needs to be replaced.

Still a further object of the present invention is to provide a shaving system wherein the indicator is a plurality of LED lights.

Yet another object of the present invention is to provide a shaving system further including a memory unit for storing a value representing the amount of time reamining until the blade needs to be replaced.

Still yet another object of the present invention is to provide a shaving system wherein the indicator is illuminated when a user activates a pressure sensor and remains lit for a short period of time thereafter, despite no shaving activity.

Another object of the present invention is to provide a shaving system including a detaching button for selectively detaching the blade from the first distal end of the razor when the indicator displays that the blade should be replaced.

A further object of the present invention is to provide a shaving system wherein the detaching button also resets the timer in the processor.

An even further object of the present invention is to provide a shaving system that indicates to a user that a razor blade should be replaced because it is dull.

Still a further object of the present invention is to provide a shaving system that reduces cuts, bumps, and irritation on the skin of a user generally caused by a dull razor blade.

Still another object of the present invention is to provide a shaving system that is simple and easy to use.

A further object of the present invention is to provide a shaving system that is passive to users, no extra steps are necessary to activate system.

Still yet another object of the present invention is to provide a shaving system that is inexpensive to manufacture and use.

Additional objects of the present invention will appear as the description proceeds.

The present invention overcomes the shortcomings of the prior art by providing a shaving system that keeps track of the amount of time in which a specific razor blade is used. The system includes a plurality of pressure sensors and razor head sensor for determining when the razor is in use. The system also includes a indicator that indicates to the user the amount of time before the blade needs to be replaced. A memory unit is included and stores the last value at which the timing mechanism reached before deactivation of the pressure sensors. Upon detaching the blade, the timing mechanism for keeping track of time is reset when a new razor head is attached.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
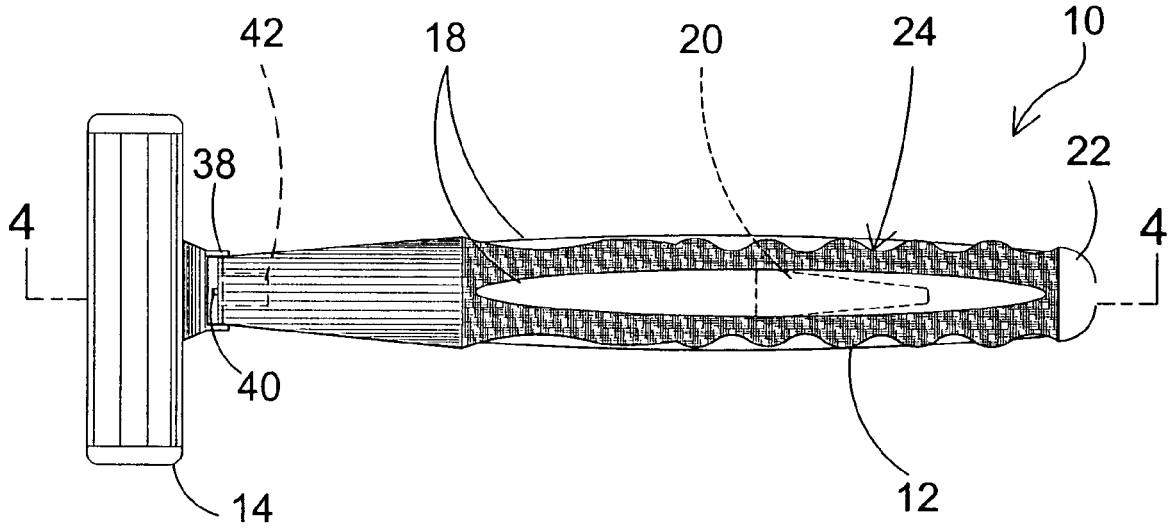
FIG. 1 is a bottom view of the shaving system of the present invention.

Turning now descriptively to the drawings, in which similar reference characters denote similar elements throughout the several views, the Figures illustrate the shaving system of the present invention. With regard to the reference numerals used, the following numbering is used throughout the various drawing Figures.

4. Protective frame
10. Shaving system
12. Razor body
14. Blade
16. Detachment switch
18. Pressure sensors
20. Indicator
21. LED's
22. Battery access cover
24 grips
26. Processor
28. Power source
34. Memory
36. Switch
38. Pivot
40. Head movement sensor plunger
42. Head movement sensor

DETAILED DESCRIPTION

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10 illustrate a shaving system of the present invention indicated generally by the numeral 10.

The present invention is a method and apparatus for a shaving system. The shaving system 10 of the present invention includes sensors so that when activated, a processor counts down from a stored predetermined time value which represents the amount of shaving time before the blade is dulled. The time remaining until the blade needs to be replaced is displayed by LED lights whereby upon all lights being extinguished, the blade should be replaced with a new blade. Alternatively the replacement of a blade may be signaled by all LED lights being illuminated. Upon depressing a blade release switch positioned on the razor body, the timer of the CPU is reset.

FIG. 1 is a bottom view of the shaving system 10 of the present invention. The shaving system 10 of the present invention includes a razor body 12 having a blade 14 positioned at a distal end thereof. A battery cover 22 is positioned at a distal end of the razor body 12 opposite the blade 14 and hermetically seals a power source therein. The blade 14 is pivotally connected to the razor body 12 via a pivot 38. The shaving system 10 further includes pressure sensor 18 positioned on the razor body 12. The pressure sensors 18 selectively determine when a user is gripping the razor body 12. Razor head movement sensor 42 and a plunger 40 for activation thereof are positioned adjacent to the pivot 38. Therefore, upon the blade 14 pivoting about the pivot 38, the plunger 40 is depressed and sensor 42 is activated. As will be discussed hereinafter with respect FIGS. 4–6, the shaving system 10 including circuitry for determining when the blade 14 is dulled and needs to be replaced. This notification occurs by an indicator 20 shown herein in shadowed outline form. Preferably the indicator 20 is positioned on the top side of the razor body 12 and is equidistant between each distal end thereof.

Figure 4:
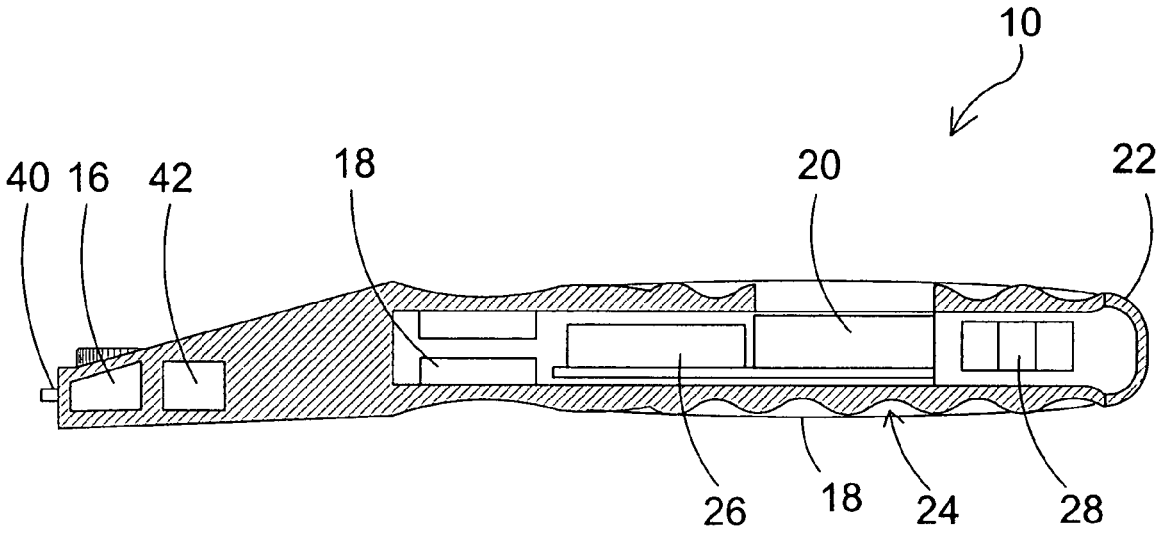
FIG. 4 is across-sectional view of the shaving system of the present invention taken along line 4—4 in FIG. 1.
Figure 5:
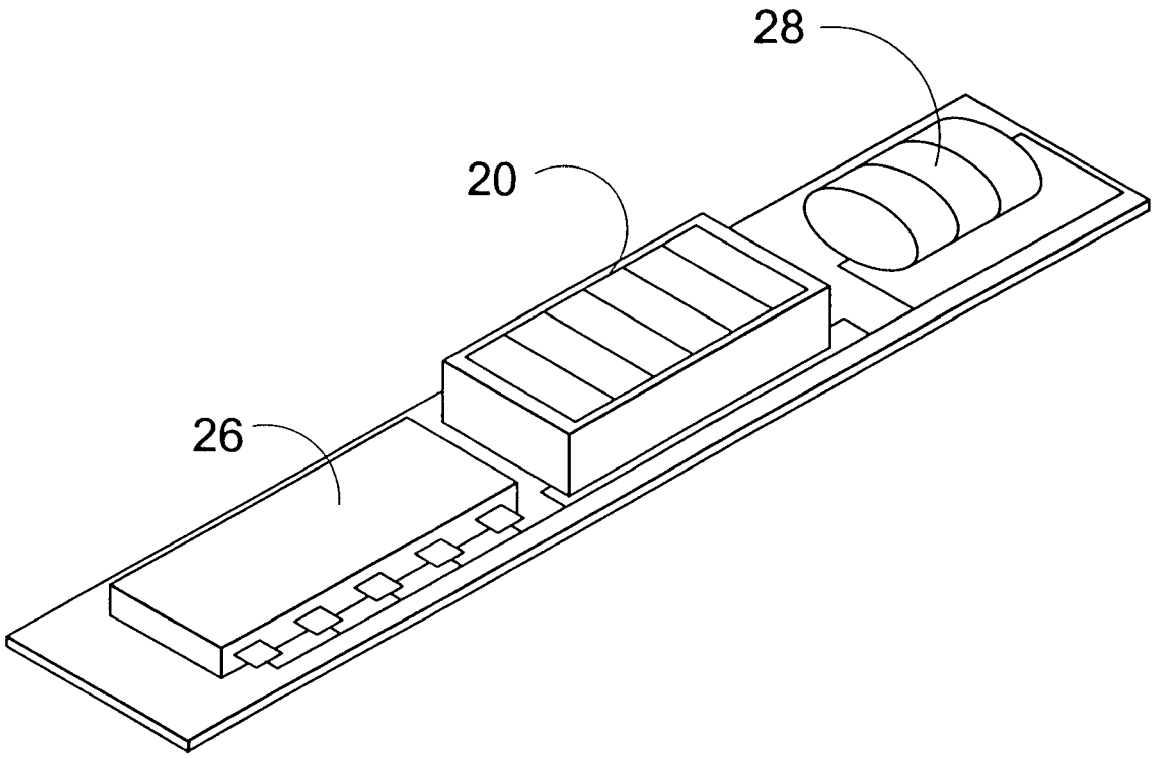
FIG. 5 is an illustrative view of the core assembly of the shaving system of the present invention.
Figure 6:
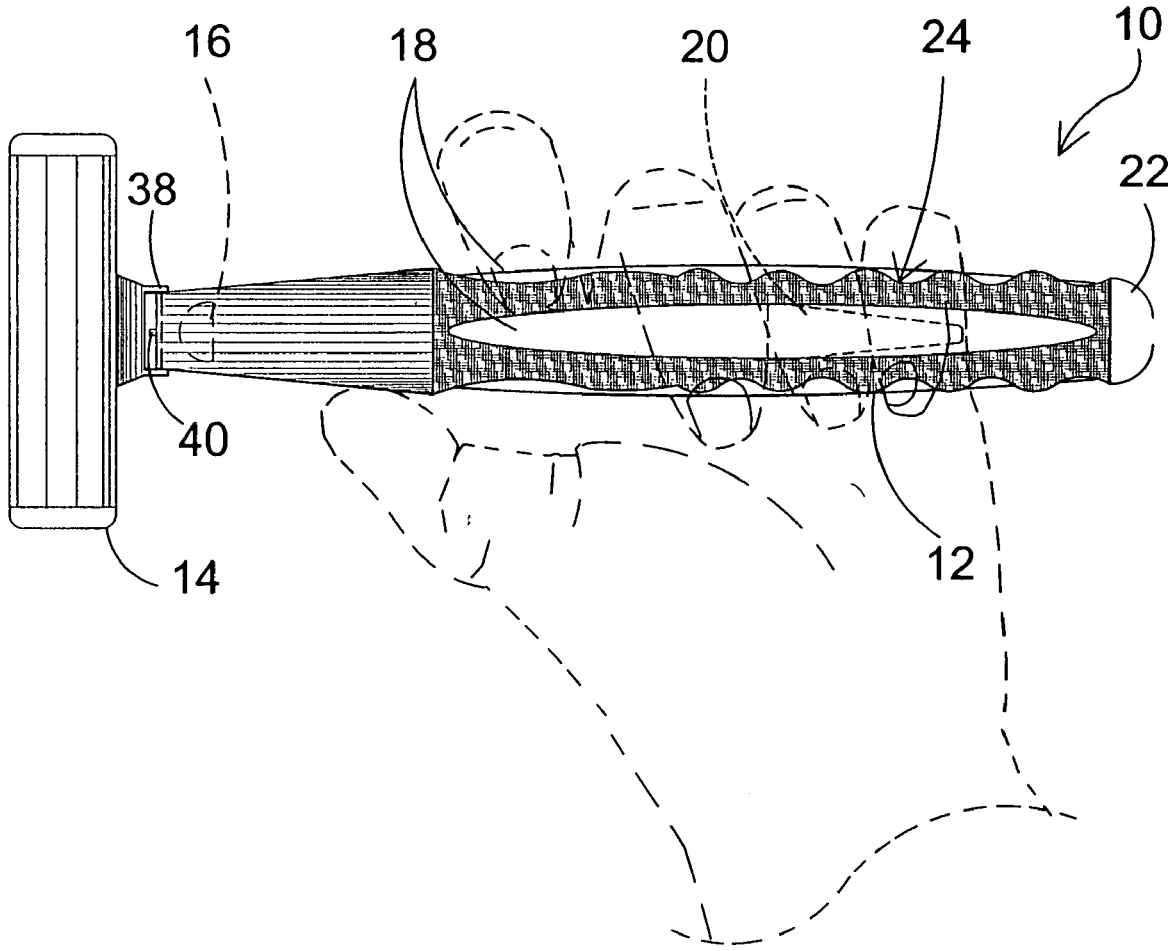
FIG. 6 is a perspective view of the shaving system of the present invention in use.

When pressure is exerted on blade 14 from the contours of the face of the user the blade 14 pivots about pivot 38 and depresses the plunger 40 and activates the head movement sensor 42. The pressure sensors 18 sense when the user grips the shaving system 10 of the present invention. Upon activation of both the head movement sensor 42 and the pressure sensor 18, the circuitry as shown in FIGS. 4–6 is activated and the user is notified as to the remaining effectiveness of the blade 14 currently connected tot the razor body 12.

Figure 2:
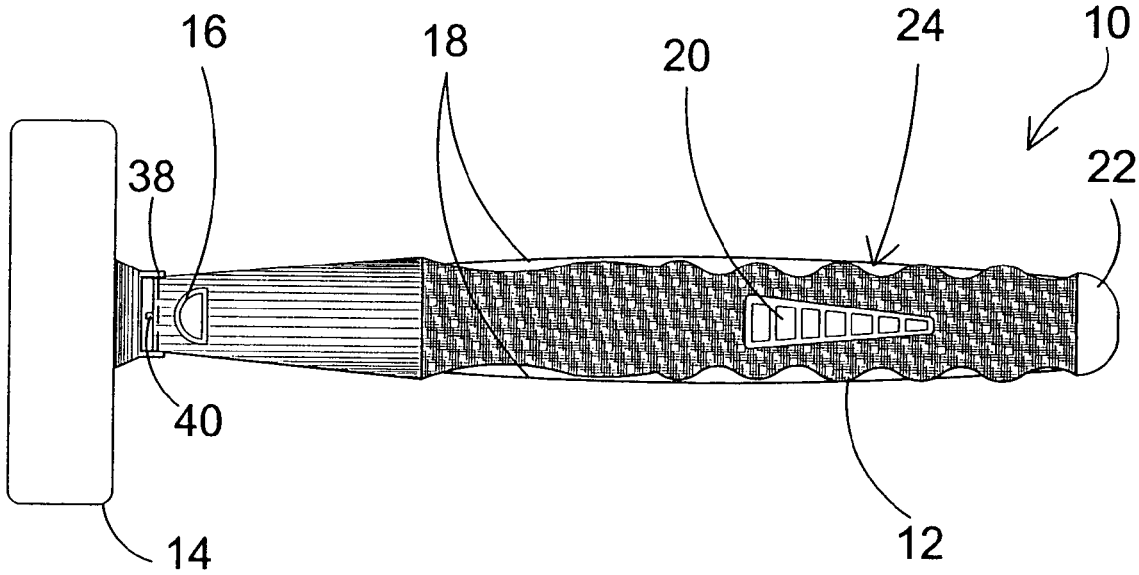
FIG. 2 is a top view of the shaving system of the present invention.

FIG. 2 is a top view of the shaving system of the present invention. The shaving system 10 of the present invention includes the razor body 12 having the blade 14 positioned at a distal end thereof. The battery cover 22 is positioned at a distal end of the razor body 12 opposite the blade 14 and hermetically seals the power source therein. The blade 14 is pivotally connected to the razor body 12 via the pivot 38. The shaving system 10 further includes the pressure sensor 18 positioned on the razor body 12. The pressure sensors 18 selectively determine when a user is gripping the razor body 12. Razor head movement sensor 42 and plunger 40 for activation thereof are positioned adjacent to the pivot 38. Therefore, upon the blade 14 pivoting about the pivot 38, the plunger 40 is depressed and sensor 42 is activated. As will be discussed hereinafter with respect FIGS. 4–6, the shaving system 10 including circuitry for determining when the blade 14 is dulled and needs to be replaced. This notification occurs by an indicator 20 shown herein in shadowed outline form. Preferably the indicator 20 is positioned on the top side of the razor body 12 and is equidistant between each distant end thereof. The shaving system 10 further includes a detaching button 16 for selectively detaching the blade 14 from the razor body 12.

When pressure is exerted on blade 14 from the contours of the face of the user the blade 14 pivots about pivot 38 and depresses the plunger 40 activates the head movement sensor 42. The pressure sensors 18 sense when the user grips the shaving system 10 of the present invention. Upon activation of both the head movement sensor 42 and the pressure sensor 18, the circuitry as shown in FIGS. 4–6 is activated and the user is notified as to the remaining effectiveness of the blade 14 currently connected tot the razor body 12. Upon the indicator 20 notifying the user to replace the blade 14, the user detaches the blade 14 via detachment button 16. Thereafter the circuitry is reset to begin counting down the time until replacement of a new blade 14.

Figure 3:
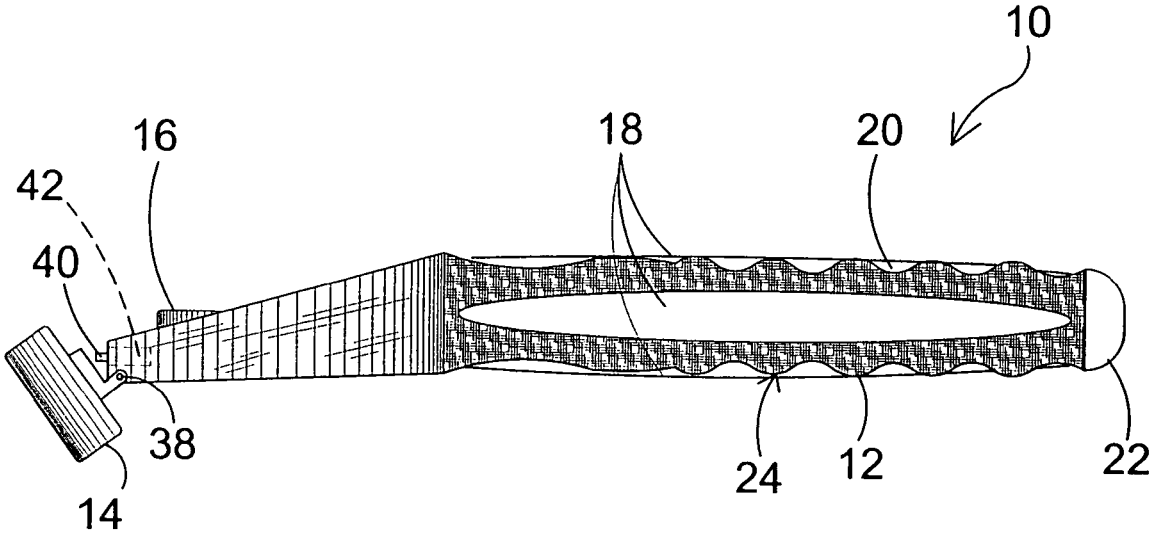
FIG. 3 is a side view of the shaving system of the present invention.

FIG. 3 is a side view of the shaving system of the present invention. The shaving system 10 of the present invention includes the razor body 12 having the blade 14 positioned at a distal end thereof. The battery cover 22 is positioned at a distal end of the razor body 12 opposite the blade 14 and hermetically seals the power source therein. The blade 14 is pivotally connected to the razor body 12 via the pivot 38. The shaving system 10 further includes the pressure sensor 18 positioned on the razor body 12. The pressure sensors 18 selectively determine when a user is gripping the razor body 12. Razor head movement sensor 42 and plunger 40 for activation thereof are positioned adjacent to the pivot 38. Therefore, upon the blade 14 pivoting about the pivot 38, the plunger 40 is depressed and sensor 42 is activated. As will be discussed hereinafter with respect FIGS. 4–6, the shaving system 10 including circuitry for determining when the blade 14 is dulled and needs to be replaced. This notification occurs by an indicator 20 shown herein in shadowed outline form. Preferably the indicator 20 is positioned on the top side of the razor body 12 and is equidistant between each distant end thereof. The shaving system 10 further includes a detaching button 16 for selectively detaching the blade 14 from the razor body 12.

When pressure is exerted on blade 14 from the contours of the face of the user the blade 14 pivots about pivot 38 and depresses the plunger 40 activates the head movement sensor 42. The pressure sensors 18 sense when the user grips the shaving system 10 of the present invention. Upon activation of both the head movement sensor 42 and the pressure sensor 18, the circuitry as shown in FIGS. 4–6 is activated and the user is notified as to the remaining effectiveness of the blade 14 currently connected tot the razor body 12. Upon the indicator 20 notifying the user to replace the blade 14, the user detaches the blade 14 via detachment button 16. Thereafter the circuitry is reset to begin counting down the time until replacement of a new blade 14.

FIG. 4 is across-sectional view of the shaving system 10 of the present invention taken along line 4—4 in FIG. 1. The shaving system 10 of the present invention includes the razor body 12 having the blade 14 positioned at a distal end thereof as shown hereinabove in FIGS. 1–3. The battery cover 22 is positioned at a distant end opposite the blade 14 and hermetically seals a power source 28 therein. The shaving system 10 further includes pressure sensor 18 positioned on the exterior of the razor body within grips 24 thereof. The pressure sensors 18 are also located in the neck of razor body 12. The pressure sensors 18 selectively determine when a user is gripping the razor body 12. Positioned within the razor body 12 is the plunger 40 which coupled to the razor head sensor 42. The shaving system 10 of the present invention further includes the circuitry as discussed hereinabove with reference to FIGS. 1–3 that determines when the blade 14 should be replaced. Thus, the shaving system includes a processor 26 which controls the operation of the shaving system 10 and is powered by power source 28 connected thereto. Additionally, the pressure sensor 18, movement sensor 42 and indicator 20 are coupled to the processor 26.

Upon activation of the pressure sensor 18 and head movement sensor 42, the processor 26 is activated and starts to countdown from a stored pre-determined time value which represents the amount of time until the blade 14 is dulled and no longer effective. The processor 26 causes the remaining time to be output by the indicator 20 to be displayed to the user. Preferably, the indicator 20 is positioned on the top side of the razor body 12 and is equidistant between each distal end thereof. The shaving system 10 further includes a detaching button 16 for selectively detaching the blade 14 from the razor body 12. The detaching button 16 is also connected to the processor 26 and, upon being depressed, causes the stored predetermined time value to be reset to the initial value.

FIG. 5 is an illustrative view of the core assembly of the shaving system 10 of the present invention. The circuitry of the system 10 as described hereinabove with specific reference to FIGS. 1–4 includes the processor 26, the indicator 20 and the power source 28 coupled thereto. As shown above with respect to FIG. 4, the pressure sensor 18, the movement sensor 42 and the detach button 16 are coupled to the processor 26 for activation thereof.

Upon activation of the pressure sensor 18 and head movement sensor 42, the processor 26 is activated and starts to countdown from a stored pre-determined time value which represents the amount of time until the blade 14 is dulled and no longer effective. The processor 26 causes the remaining time to be output by the indicator 20 to be displayed to the user. Preferably, the indicator 20 is positioned on the top side of the razor body 12 and is equidistant between each distal end thereof. The shaving system 10 further includes a detaching button 16 for selectively detaching the blade 14 from the razor body 12. The detaching button 16 is also connected to the processor 26 and, upon being depressed, causes the stored predetermined time value to be reset to the initial value.

FIG. 6 is a perspective view of the shaving system 10 of the present invention in use. The shaving system 10 of the present invention includes the razor body 12 having the blade 14 positioned at a distal end thereof. The battery cover 22 is positioned at a distal end of the razor body 12 opposite the blade 14 and hermetically seals the power source therein. The blade 14 is pivotally connected to the razor body 12 via the pivot 38. The shaving system 10 further includes the pressure sensor 18 positioned on the razor body 12. The pressure sensors 18 selectively determine when a user is gripping the razor body 12. Razor head movement sensor 42 and plunger 40 for activation thereof are positioned adjacent to the pivot 38. Therefore, upon the blade 14 pivoting about the pivot 38, the plunger 40 is depressed and sensor 42 is activated. As will be discussed hereinafter with respect FIGS. 4–6, the shaving system 10 including circuitry for determining when the blade 14 is dulled and needs to be replaced. This notification occurs by an indicator 20 shown herein in shadowed outline form. Preferably the indicator 20 is positioned on the top side of the razor body 12 and is equidistant between each distant end thereof. The shaving system 10 further includes a detaching button 16 for selectively detaching the blade 14 from the razor body 12.

When pressure is exerted on blade 14 from the contours of the face of the user the blade 14 pivots about pivot 38 and depresses the plunger 40 activates the head movement sensor 42. The pressure sensors 18 sense when the user grips the shaving system 10 of the present invention. Upon activation of both the head movement sensor 42 and the pressure sensor 18, the circuitry as shown in FIGS. 4–6 is activated and the user is notified as to the remaining effectiveness of the blade 14 currently connected tot the razor body 12. Upon the indicator 20 notifying the user to replace the blade 14, the user detaches the blade 14 via detachment button 16. Thereafter the circuitry is reset to begin counting down the time until replacement of a new blade 14.

As shown herein, a user is gripping the razor body 12 via the grips 24 thereby activating the pressure sensor 18. Once the user causes the blade to be moved along a surface including but not limited to the face, legs, chest, back, underarms and arms, the plunger 40 will be depressed and the movement sensor will be activated. As stated above, once both the pressure sensor 18 and the movement sensor 42 are activated, the system 10 of the present invention begins to count down the time remaining until the blade 14 is no longer effective and should be replaced.

Figure 7:
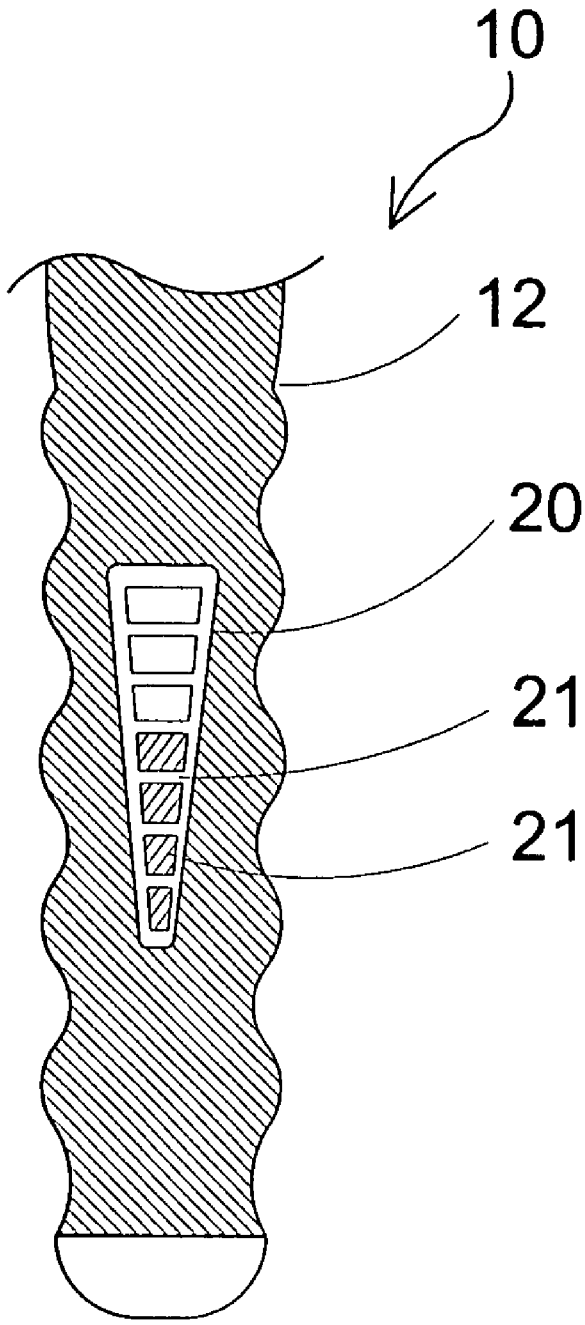
FIG. 7 is an enlarged view of the shaving system of the present invention.

FIG. 7 is an enlarged view of the indicator 20 of the shaving system 10 of the present invention. The indicator 20 is positioned on the top side of the razor body 12. The indicator 20 includes a plurality of LED lights 21 vertically adjacent to one another. The size of each respective LED light 21 decrease from the immediately preceding LED light 21 when looking in at least one of base to blade direction and in a blade to base direction.

When the shaving system 10 of the present invention is activated and the processor 26 as described hereinabove with respect to FIGS. 4–6 begins counting down from the initial stored predetermined time value, the processor 26 causes a value representing the remaining time until the blade 14 needs to be replaced to be output by the LED lights 21 of the indicator 20. The Preferably, the LED lights 21 are all illuminated when the processor 26 determines that the time remaining is equal to the stored predetermined time value. As the time remaining decreases, the processor 26 causes a corresponding LED light 21 to no longer be illuminated. When there are no more LED lights 21 illuminated, the blade 14 is to be replaced.

Alternatively, the processor 26 causes the no LED lights to be illuminated when the time remaining equals the stored predetermined time value. As the time remaining decreases, the processor 26 causes the LED lights to be illuminated. When all LED lights 21 of the indicator 20 are illuminated, the user is signaled to replace the blade.

Upon the indictor 20 signaling the user to replace the blade 14, the user selectively detaches the blade 14 using the detaching button 16 as shown above in FIGS. 2–4. Thereafter, the time value stored in the processor 26 is reset to equal the stored predetermined time value.

Figure 8:
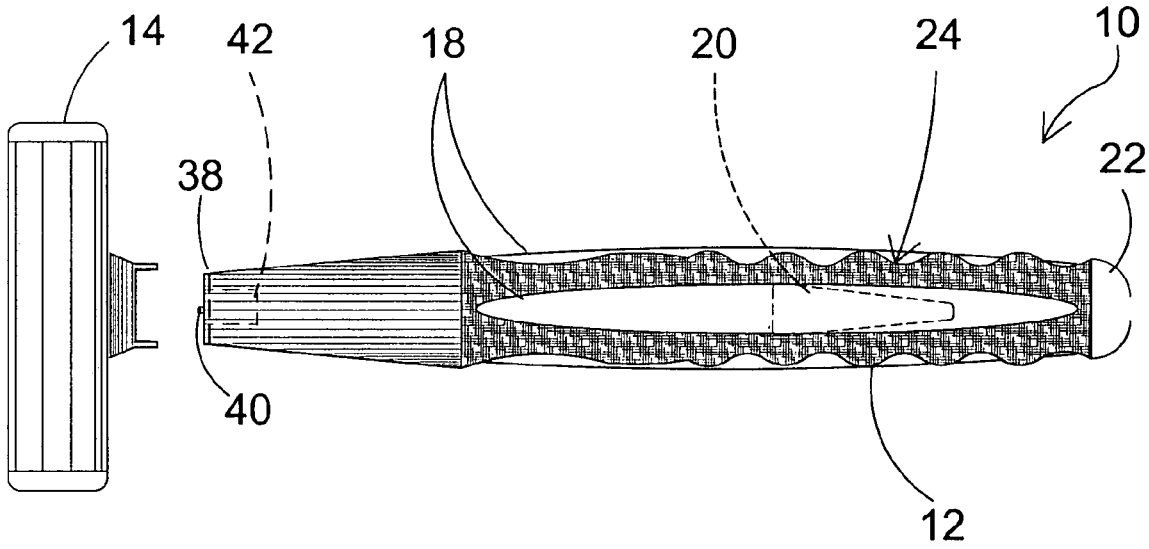
FIG. 8 is an exploded view of the shaving system of the present invention having the blade detached therefrom.

FIG. 8 is an exploded view of the shaving system of the present invention having the blade detached therefrom. The shaving system 10 of the present invention includes the razor body 12 having the blade 14 positioned at a distal end thereof. The battery cover 22 is positioned at a distal end of the razor body 12 opposite the blade 14 and hermetically seals the power source therein. The blade 14 is pivotally connected to the razor body 12 via the pivot 38. The shaving system 10 further includes the pressure sensor 18 positioned on the razor body 12. The pressure sensors 18 selectively determine when a user is gripping the razor body 12. Razor head movement sensor 42 and plunger 40 for activation thereof are positioned adjacent to the pivot 38. Therefore, upon the blade 14 pivoting about the pivot 38, the plunger 40 is depressed and sensor 42 is activated. As will be discussed hereinafter with respect FIGS. 4–6, the shaving system 10 including circuitry for determining when the blade 14 is dulled and needs to be replaced. This notification occurs by an indicator 20 shown herein in shadowed outline form. Preferably the indicator 20 is positioned on the top side of the razor body 12 and is equidistant between each distant end thereof. The shaving system 10 further includes a detaching button 16 for selectively detaching the blade 14 from the razor body 12.

When pressure is exerted on blade 14 from the contours of the face of the user the blade 14 pivots about pivot 38 and depresses the plunger 40 activates the head movement sensor 42. The pressure sensors 18 sense when the user grips the shaving system 10 of the present invention. Upon activation of both the head movement sensor 42 and the pressure sensor 18, the circuitry as shown in FIGS. 4–6 is activated and the user is notified as to the remaining effectiveness of the blade 14 currently connected tot the razor body 12. Upon the indicator 20 notifying the user to replace the blade 14, the user detaches the blade 14 via detachment button 16. Thereafter the circuitry is reset to begin counting down the time until replacement of a new blade 14.

As shown in FIG. 8, the indicator 20 signaled to the user that the blade 14 is no longer effective and the user depressed the detaching button 16 to detach the blade 14 from the razor body 12. Upon depressing the detaching button 16, the circuitry was reset to the initial stored predetermined time value. Upon re-attaching a new blade 14, the shaving system 10 is able ready to countdown the time remaining until the newly attached blade 14 is no longer effective.

Figure 9:
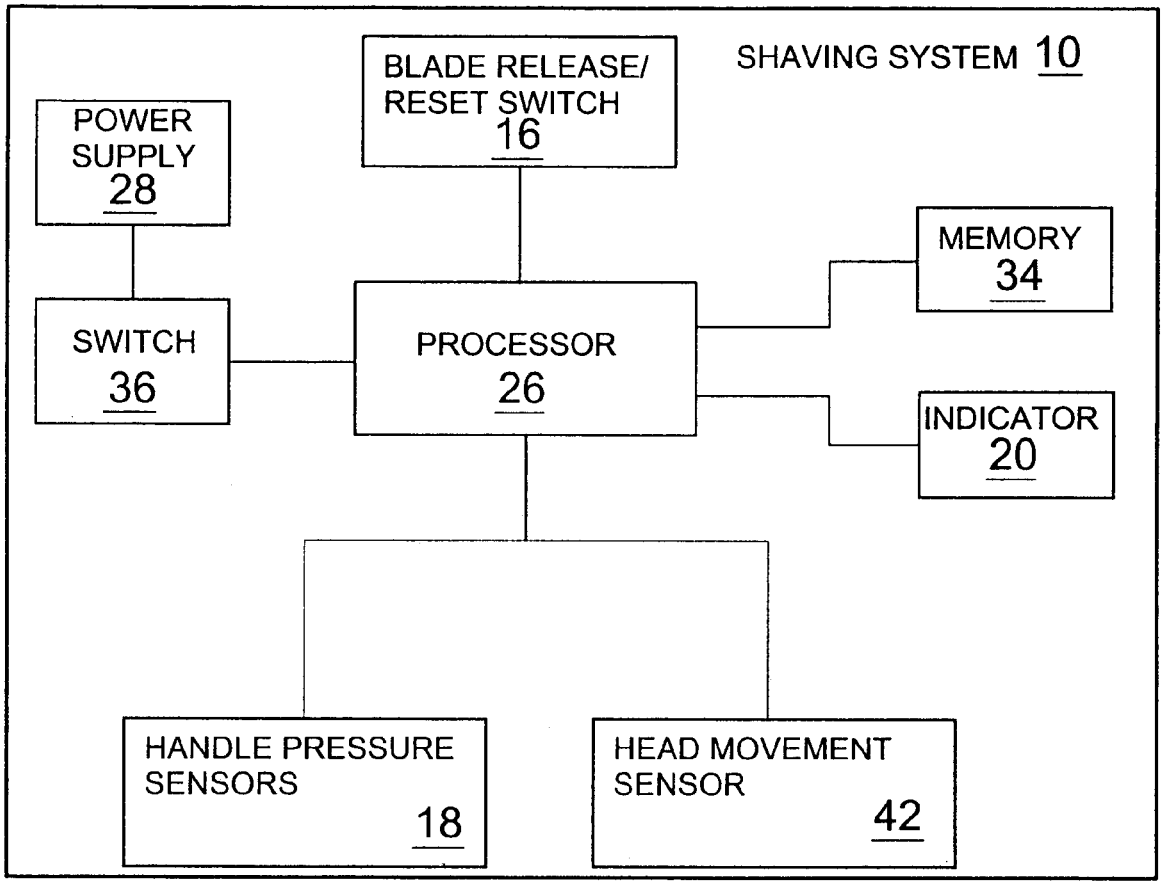
FIG. 9 is a block diagram of the shaving system of the present invention.

FIG. 9 is a block diagram of the shaving system 10 of the present invention. The shaving system 10 of the present invention includes the processor 26. The shaving system 10 is powered by the power souce 28 which is connected via a switch 36 to the processor 26. Also connected to the processor 26 is the detaching button 16, the indicator 20, the pressure sensor 18 and the movement sensor 42. Also connected to the processor 26 is a memory unit 34 for storing a value representing the amount of time remaining before the blade needs to be replaced.

The processor 26 includes a stored predetermined time value therein which represents the amount of time that the blade connected to the razor body can be used effectively. Upon activation of the pressure sensor 18 and the movement sensor 42, the processor 26 begins to count down from the stored predetermined value until the value equals a zero value which signifies that the blade needs to be replaced. However, it is unlikely that the stored value will reach the zero value in a single use. Thus, while the sensors 18, 42 are activated, the processor counts down the stored value. Upon deactivation of the sensors 18, 42 the processor 26 causes the value representing remaining time until zero value to be stored in the memory 34. Upon a second activation of the sensors 18, 42, the processor 26 determines if a value is stored in the memory 34. If a value is stored, then the processor 26 begins the countdown to the zero value using the value stored in memory as the starting value.

As the processor 26 is counting down as described above, the processor 26 simultaenously outputs a visible indication of how much time is remaining via the indicator 20. When and if a value is stored in memory 34, the visible representation of that value is also stored in memory 34. Thus, upon a second use of the shaving system 10, the user is made aware approximately how much time is remaining until the blade need to be replaced.

Upon the processor 26 determining that the value equals zero, the indicator 20 signals that the blade needs to be replaced. The user depressed the detaching button 16 and the blade is detached from the razor body. Additionally, the memory unit 34 is erased and the counting value of the processor 26 is reset to the initial stored predetermined value.

Figure 10:
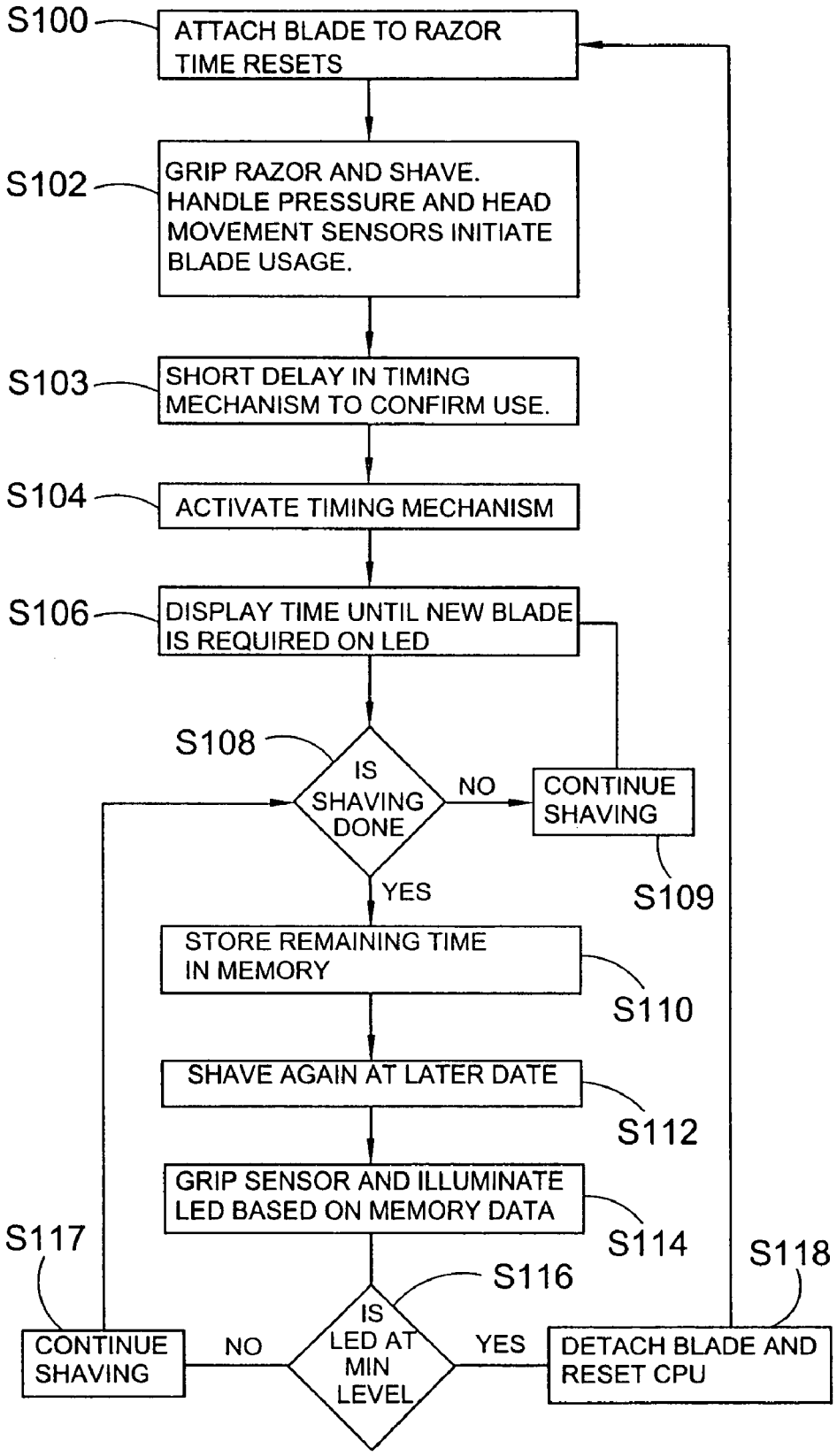
FIG. 10 is a flow diagram detailing the use and operation of the shaving system of the present invention.

FIG. 10 is a flow diagram detailing the use and operation of the shaving system of the present invention. At the first step, step S100, the user attaches a blade to the razor and the clock countdown time resets to the stored predetermined time value. When a user, in step S102, activates the system to shave, activating the pressure sensors 18 in the grip and the head movement sensor 42 adjacent to the pivot 38, the processor detects that blade is being used. To confirm use of the system a short delay in activation of the timing mechanism is shown in step S103. After confirming use through the use of a time delay in step s103, the timing mechanism is activated in step S104. In step S106, the system displays the time remaining until the blade needs to be replaced via the LED 21 of the indicator 20. Step S108 proceeds to continuously check whether the user is done shaving by checking the state of the pressure and movement sensors. If the user continues to shave or activate the sensors then the system proceeds to step S109 to continue shaving and back to step S106 until it finds that the activation state of the sensors has changed. When the user finishes shaving and releases the sensors the system will proceed to step s110 and store the remaining time before the blade dulls in the memory 34. Upon shaving again at another date in step S112, the user activates the pressure sensors 18 and head movement sensor 42 thereby activating the system 10 and illuminating the LED's based on our previously stored memory data. In step S116, the system checks if the LED display 20 is at a minimum level indicating that the razor needs to be replaced. If the LED display 20 level is not at a minimum then system proceeds in step S117 and the user continues to shave. Thereafter, the system inquires as to whether the shaving is finished as discussed above in step S1108. If the LED display 20 is at a minimum level indicating the blade is dull then the system proceeds to step S118 and blade is detached and the processor is reset. The system is then ready to countdown the time remaining for the newly attached blade 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shaving system comprising:

a) a razor body having a blade releaseably secured at a first distal end thereof;

b) a processor having a timing mechanism positioned within said razor body;

c) a pressure sensor positioned externally on said razor body for selectively determining if said razor body is being gripped, said pressure sensor is coupled to said processor;

d) a movement sensor positioned adjacent to said blade and within said razor body for selectively determining whether said blade is moving along a surface, said movement sensor coupled to said processor; and e) means for indicating that said blade should be replaced; wherein upon said pressure sensor and said movement sensor being activated simultaneously, said timing mechanism is caused to count down from a predetermined initial value representing an amount of time required until said blade needs to be replaced which is indicated by said indicating means.

2. The system as recited in claim 1, wherein said blade is pivotally connected to said first distal end of said razor body.

3. The system as recited in claim 2, further comprising a plunger connected between said blade and said movement sensor, wherein said blade pivots about an axis and causes said plunger to be depressed thereby activating said movement sensor.

4. The system as recited in claim 1, wherein said razor body further comprises a plurality of grips positioned thereon.

5. The system as recited in claim 4, wherein said pressure sensor is positioned between said grips and said razor body.

6. The system as recited in claim 1, further comprising a memory unit coupled to said processor for storing a remaining time value representing the amount of time remaining from said initial value until said blade needs to be replaced.

7. The system as recited in claim 6, wherein said processor provides said remaining value to said indicating means for visually indicating to a user said remaining time value.

8. The system as recited in claim 7, wherein upon a second simultaneous activation of said pressure and movement sensors, said stored remaining time value is provided to said processor for counting down therefrom.

9. The system as recited in claim 1, further comprising a detaching button connected to said blade for detachment thereof.

10. The system as recited in claim 9, wherein said detaching button is coupled to said processor and upon detachment of said blade, said timing mechanism of processor is reset to said predetermined initial value.

11. The system as recited in claim 8, further comprising a detaching button connected to said blade for detaching thereof.

12. The system as recited in claim 11, wherein said detaching button is coupled to said processor and said memory and upon detachment of said blade, said timing mechanism of processor is reset to said predetermined initial value and said memory is erased.

13. The system as recited in claim 1, wherein said indicating means is a plurality of LED lights, wherein each respective LED light decreases in size in at least one of an upward vertical direction and a downward vertical direction.

14. The system as recited in claim 1, wherein said indicating means is an LCD display for displaying an amount of time remaining until said blade needs to be replaced.

15. The system as recited in claim 1, wherein said processor further includes a check mechanism for confirming that said pressure sensor and said movement sensor are simultaneously activated.

* * * * *